United States Patent [19]

Laing

[11] 4,352,215

[45] Oct. 5, 1982

[54] JET STREAM DEVICE

[76] Inventor: Karsten Laing, Herrenstrasse 57,, 7500 Karlsruhe, Fed. Rep. of Germany

[21] Appl. No.: 141,219

[22] Filed: Apr. 17, 1980

[30] Foreign Application Priority Data

Apr. 17, 1979 [AT] Austria ..... 2863/79

[51] Int. Cl.[3] ..... E04H 3/16

[52] U.S. Cl. ..... 4/492; 415/182; 415/209

[58] Field of Search ..... 4/488, 491, 492, 496, 4/501, 541, 542, 544; 128/66; 272/26; 417/366; 415/182, 148, 209

[56] References Cited

U.S. PATENT DOCUMENTS

| | | | |
|---|---|---|---|
| 1,595,357 | 8/1926 | Nims et al. | 415/182 |
| 1,696,776 | 12/1928 | Menge | 415/182 |
| 2,625,720 | 1/1953 | Ross | 415/182 |
| 3,534,413 | 10/1970 | Plasseraud | 4/492 |
| 3,820,173 | 6/1974 | Weller | 4/496 |
| 3,969,043 | 7/1976 | Bright et al. | 417/366 |
| 4,086,775 | 5/1978 | Peterson, Jr. | 415/182 X |
| 4,253,202 | 3/1981 | Norris | 4/512 X |

FOREIGN PATENT DOCUMENTS

| | | | |
|---|---|---|---|
| 2209507 | 9/1973 | Fed. Rep. of Germany | 4/491 |
| 2319902 | 11/1974 | Fed. Rep. of Germany | 4/491 |

*Primary Examiner*—Charles E. Phillips

*Attorney, Agent, or Firm*—Pennie & Edmonds

[57] ABSTRACT

Jet stream device consisting of a submersible electrical motor, a pump, a housing, an outlet nozzle and fixing means, in which the motor drives the impeller of an axial pump, located in a necked-down portion of the casing and wherein the smallest cross-section of said necked-down portion coincides approximately with the cross-section of the outlet nozzle, which is positioned behind the necked-down portion and wherein furthermore motor, pump impeller, necked-down portion and outlet nozzle are surrounded by a housing whose width coincides approximately with the width of the outlet nozzle.

6 Claims, 5 Drawing Figures

Fig. 1
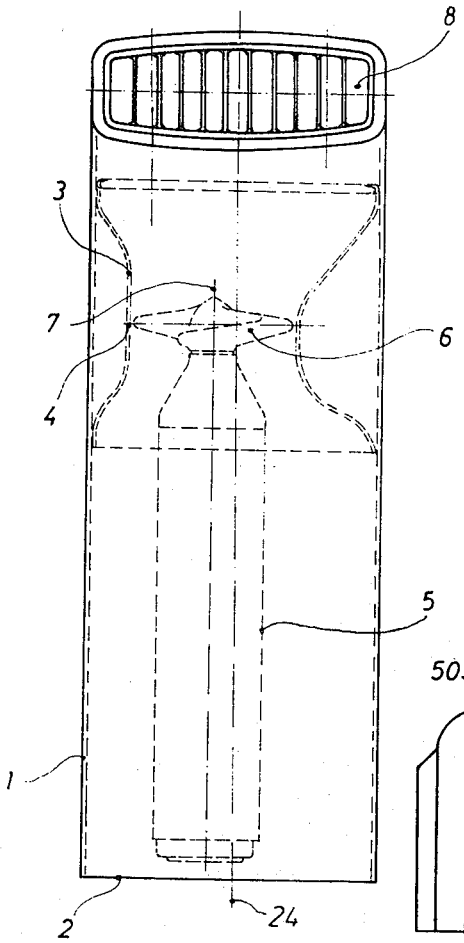
Fig. 2
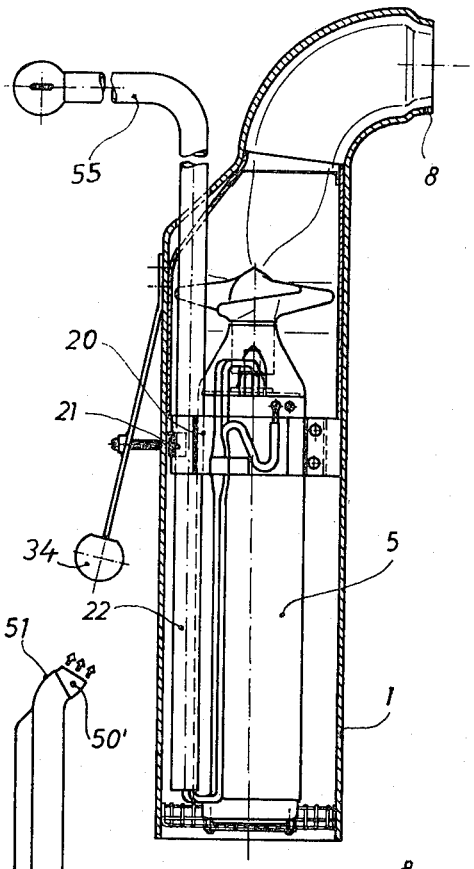
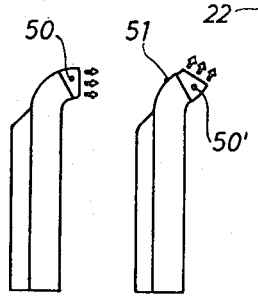
Fig.5
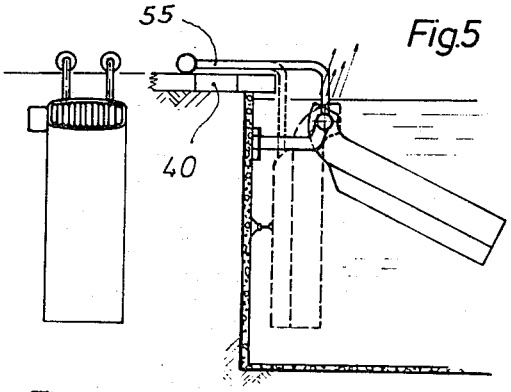
Fig. 4
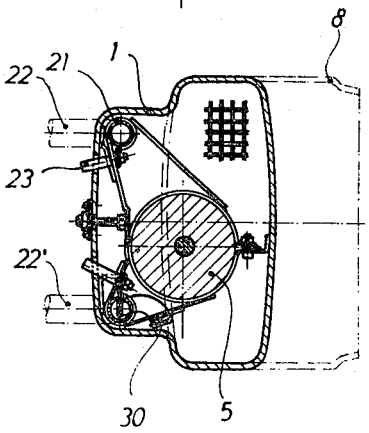
Fig. 3

JET STREAM DEVICE

The invention relates to a jet stream device for swimming pools.

Jet stream devices for swimming pools enable a person "to swim on the spot". Known devices are equipped with a centrifugal pump, producing a relatively high pressure, through which the sucked pool water leaves the device via one or more small apertures. Such devices have either to be installed in a hole outside the swimming pool, which requires a perforation through the sealing wall of the pool, or to be located at the pool edge. Thus in the first case, considerable masonry work has to be done, while in the second case such devices are suitable neither for non-rigid plastic pools nor for pools with thin metallic walls. Moreover, devices have become known, which are equipped with a submersible motor and a centrifugal pump with small discharge and high outlet velocities.

It results from the thrust equation, that the pump performance at a constant thrust corresponds to $$P \approx \frac{1}{\sqrt{a}}$$

where

P=hydraulic power of the pump a=outlet area of the nozzle.

That means the larger the outlet surface, the smaller the required driving power.

The invention relates to devices which are located, like conventional devices, below the swimming pool water level, which can, hence, be flooded. They use axial impellers and do not have, according to the above equation, high outlet velocities but large outlet surfaces instead. It was found that the same hydraulic thrusts, for which in case of conventional outlet velocities powers of 4–5 kW are required, can be reached with only 0.66 kW in case of outlet velocities of about 2 meters per second, if the outlet nozzle has a large horizontal extension, whereby a flat jet as wide as the body of a swimmer, is produced. This is of particular importance for swimming pool drive means, since herewith a single-phase connection of the motor becomes possible, while, for example, 4 kW motors require a three-phase connection. Since protective transformers or leakage current switches are required for swimming pool devices, the auxiliary electric equipment for the single-phase connection is considerably reduced.

The use of axial impellers has hitherto not been possible due to the very unequal velocity distribution over the outlet area. In a nozzle according to the invention, this would result in water leaving the device at high velocity only on one side of the device. In order to avoid this the axis of the axial impeller does not coincide with the vertical axis of the device. Due to the small dimensions of the axial pump and of the motor, the device may be so light-weight and small that it can also be installed in small swimming pools. Furthermore, it is possible to mount the device pivotably, whereby different effects can be produced. The same device can, for example, be used not only for swimming purposes, for producing waves and for massage purposes, but also for producing water fountains. It is desired that the thrust of the water jet is so large that the swimmer cannot reach the device, even if he tries hard. This is not possible with conventional devices, since water jets leaving at high velocities may lead to bodily injuries. This is impossible with water discharged in large quantities and at small outlet velocities. The device according to the invention is, therefore, preferably designed for a jet thrust which is so large that the swimmer cannot reach the device. On the other hand, conventional hand-operated switches may no longer be used.

Accordingly, the invention relates furthermore to a switch which does not require a button to be pressed. According to the invention the switch, located outside the pool, is electromagnetically operated. The switching impulse is supplied by a sound amplifier at frequencies between 15,000 and 25,000 hertz. In order to operate the switch the swimmer claps his wet hands.

The invention will now be described, by way of example, with reference to the accompanying diagrammatic drawings, in which:

FIG. 1 is a front elevation of the device,

FIG. 2 shows the interior of the device,

FIG 3 shows a horizontal cross-section of the device,

FIG. 4 shows pivotal arrangement of the device, and

FIG. 5 shows the attachable nozzle.

The device has a box-type design, the water entering at the lower open end 2 of the housing 1 thereof. A necked-down portion 3 is positioned in the interior of the housing 1, the portion 3 being substantially circular in its smallest cross-section 4. A motor 5 drives an axial impeller 6, the motor 5 being concentrically positioned below said throughflow cross-section. In order to compensate for the impeller drift, the axis of rotation of the impeller 6 is laterally displaced relative to the vertical axis 24 of the housing, so that the discharge distribution is approximately constant over the horizontal extension of the outlet nozzle 8. If the impeller 6 is right-handed (as shown), and consequently, rotates anti-clockwise (when looked at from above), the axis 7 must be shifted to the left (in FIG. 1) relative to the plane of symmetry of the device. The outlet area of the outlet nozzle is approximately as large as the outlet area in the smallest cross-section 4 of the necked-down portion 3, so that retarding losses are avoided. The width should correspond to the width of the body of a swimmer.

FIG. 2 is a side elevation of the device in section. The motor 5 is fixed by a clamp 20 which is fixed by shims 21 to tubes 22 and adjustable in height. The screws 23 for the shims are accessible from the outside in order to enable the adjustment in height.

FIG. 3 is a horizontal corss-section through the housing 1, the penetrating fixing tubes 22, 22′ as well as the motor 5. The clamp 20 is laid through one of the tubes 22, 22′. The support element 34 is positioned at the back side of the housing, by which the distance of the device from the wall can be adjusted.

The supporting tubes 22, 22′ extend along the edges of the rearside of the housing and are held parallel thereto without the necessity of any further element. The bent upper part 55 of the tubes 22 and 22′ should run above the pool edge 40, so that cover means for the pool will not be hindered.

FIG. 4 shows an alternative embodiment of the tubes, for which a pivot joint in the nozzle area is provided, which enables the device to be pivoted into a nearly horizontal position. In the position shown in this figure the jet stream leaves the device at the water surface.

FIG. 5 shows an alternate arrangement in which, as shown in FIG. 5*a*, the jet stream is directed by a nozzle element 50 either horizontally or, as shown in FIG. 5*b*, leaves the device in a nearly vertical direction, which is achieved by turning the element 50 to the position marked 50'. The device is switched on by a magnetically actuated switch operated by a control device. This control device comprises a microphone and a microphone amplifier with a resonance circuit, whose resonance frequencies lie between 15,000 and 25,000 hertz. The control device makes it possible to switch the device on and off without touching anything. The sound is either conventionally produced by an ultrasound whistle or, according to the invention, by hand clapping. It was found that clapping of wet hands produces extremely high sound amplitudes in the above-mentioned range of frequencies. Thus, the device can be switched on or off without the necessity of touching anything.

I claim:

1. Jet stream device for a swimming pool, the device comprising a longitudinally extending housing having at one end an inlet and at the other end an outlet nozzle, a flow-constricting necking situated between the inlet and the nozzle, an axial impeller rotatable by an underwater motor with said impeller being situated in the necking with its axis of rotation extending parallel to the longitudional axis of the housing and to the left of a central plane passing through the housing and nozzle when rotatable in an anticlockwise direction when viewed through the nozzle and to the right of said central plane when rotatable in a clockwise direction when viewed through the nozzle, the smallest cross-sectional area of the necking being approximately the same size as that of the nozzle and the width of the housing being approximately the same size as that of the nozzle, two tubular suspension elements extending into the housing and bent to rest directly on the edge of a pool parallel thereto, means for adjustable attachment of the device to the suspension means, and means for keeping the device at a distance from a vertical wall of a swimming pool, the device being tiltable about a horizontal axis and consequently its outlet nozzle being tiltable about said horizontal axis.

2. A device according to claim 1 wherein the width of the nozzle is substantially greater than its height.

3. A device according to claim 1 or 2 wherein the width of the nozzle is approximately as wide as the body of a swimmer.

4. A device according to claim 1 wherein the elements extend into the rear part of the housing the width of which is so adjusted that the elements extend along the edge of that part.

5. A device according to claim 1 wherein the outlet nozzle is formed by an adjustable element the outlet cross-section of which may be positioned in two different planes which make 45° with each other.

6. A device according to claim 1 wherein the motor is controlled by a switch which is actuated by an electromagnet which receives its switching impulse from a sound amplifier which generates a sound impulse on receiving sound frequencies in the region between 15,000 and 25,000 Hz.

* * * * *